US009958230B1

(12) United States Patent
Nugent et al.

(10) Patent No.: US 9,958,230 B1
(45) Date of Patent: May 1, 2018

(54) RAPID FIRE TOY LAUNCH APPARATUS

(71) Applicant: Hasbro, Inc., Pawtucket, RI (US)

(72) Inventors: David Michael Nugent, Newport, RI (US); Tadeusz W Keska, Smithfield, RI (US)

(73) Assignee: Hasbro, Inc., Pawtucket, RI (US)

( * ) Notice: Subject to any disclaimer, the term of this patent is extended or adjusted under 35 U.S.C. 154(b) by 0 days. days.

(21) Appl. No.: 15/365,692

(22) Filed: Nov. 30, 2016

Related U.S. Application Data

(60) Provisional application No. 62/270,818, filed on Dec. 22, 2015.

(51) Int. Cl.

| | |
|---|---|
| ***F41B 7/08*** | (2006.01) |
| ***F41B 4/00*** | (2006.01) |
| ***F41B 11/50*** | (2013.01) |
| ***F41B 7/00*** | (2006.01) |

(52) U.S. Cl.
CPC ..... *F41B 4/00* (2013.01); *F41B 7/003* (2013.01); *F41B 7/08* (2013.01); *F41B 11/50* (2013.01)

(58) Field of Classification Search
CPC .. F41B 7/003; F41B 7/006; F41B 7/08; F41B 11/50; F41B 11/54; F41B 11/55; F41B 11/57
See application file for complete search history.

(56) References Cited

U.S. PATENT DOCUMENTS

| | | | | |
|---|---|---|---|---|
| 2,737,942 | A * | 3/1956 | Horowitz | F41B 7/006 124/27 |
| 2,825,324 | A * | 3/1958 | Haas | F41B 7/006 124/27 |
| 3,111,121 | A * | 11/1963 | Baggott | F41A 15/12 124/44.7 |
| 3,869,825 | A * | 3/1975 | Heberlein | A63H 17/045 124/52 |
| 3,990,426 | A | 11/1976 | Stokes | |
| 4,841,945 | A | 6/1989 | Braden | |
| 4,850,328 | A * | 7/1989 | Sindel | F41B 11/55 124/41.1 |
| 4,890,404 | A | 1/1990 | Ferri | |
| 5,471,967 | A | 12/1995 | Matsuzaki et al. | |
| 6,488,019 | B2 | 12/2002 | Kotsiopoulos | |
| 7,051,727 | B2 | 5/2006 | Wu | |
| 8,082,909 | B2 | 12/2011 | Sopinsky et al. | |
| 8,695,579 | B2 | 4/2014 | Huebl | |
| 2002/0166551 | A1 | 11/2002 | Lee | |
| 2009/0095272 | A1 | 4/2009 | Zimmerman | |
| 2013/0112184 | A1 | 5/2013 | Corsiglia et al. | |
| 2013/0312722 | A1 | 11/2013 | Price | |

* cited by examiner

*Primary Examiner* — John Ricci
(74) *Attorney, Agent, or Firm* — Perry Hoffman

(57) ABSTRACT

A rapid fire toy dart launch apparatus employing a feeding/anti-jamming mechanism including a simply yet unique continuous belt that penetrates a dart magazine releasing each dart from the magazine and simultaneously employing protrusion elements at the belt advancing each released dart into an energy generating mechanism for rapidly firing darts from the toy apparatus without mis-fed darts jamming up in the launcher.

23 Claims, 10 Drawing Sheets

RAPID FIRE TOY LAUNCH APPARATUS

CROSS-REFERENCE TO RELATED APPLICATION

This application claims priority pursuant to 35 U.S.C. 119(e) to U.S. Provisional Application No. 62/270,818, filed on Dec. 22, 2015 which is incorporated herein by reference in its entirety.

1. Field of the Invention

The present invention relates to toy projectile launchers and more particularly, to a rapid fire toy launch apparatus employing a feeding/anti-jamming mechanism including a simple yet unique continuous belt that penetrates a dart magazine releasing each dart from the magazine and simultaneously employing protrusion elements at the belt advancing each released dart into an energy generating mechanism for rapidly firing darts from the toy apparatus without mis-fed darts jamming up in the launcher.

2. Background of the Invention

Projectile launchers/shooting mechanisms are well known in the art and include mechanisms for launching toy darts, balls of various sizes, paint balls, etc., and even paper money. Various toy launchers/guns known in the art employ a projectile shooting mechanism made up of two opposed rotatable wheels (known as a drive or fly wheels) which engage a dart or other various balls and projectiles there between. A motor drives rotation of one or both wheels creating a launching force frictionally applied to the dart/projectile as the dart/projectile engages a wheel surface on each of the opposed rotatable wheels. The rotating wheels impart sufficient energy to the dart/projectile to launch the dart/projectile from the gun/shooter or hopper.

Some known methods/mechanisms for feeding darts into a drive or fly wheel or other energized launching mechanism includes advancing mechanisms actively pushing darts or projectiles into an energized launching mechanism or, alternatively, mechanisms which remove physical barriers from a path or channel leading to a launching mechanism. None of the known feeding mechanisms however, employ a continuous belt which penetrates a dart magazine to release each dart while at the same time employs one or more protrusion elements at the belt to advance each released dart in a rapid fire, anti-jamming manner, into the launching mechanism.

Various known feeding mechanisms employ rods, pistons or hammers which actively push darts into an adjacent launching mechanism. Feeding mechanisms are known to include an elongated arm biased into contact with a stack of darts lined up adjacent a drive wheel. The arm is biased into contact with the upper most dart of the stack and urges the lower most dart into the barrel adjacent the drive wheel. A biased trigger and hammer arrangement push the dart through the barrel and into the drive wheel for firing the dart when the trigger is pulled.

Also known is a trigger lever which rotates when pulled, translating into movement of a bullet pusher to advance a bullet toward rotating projector wheels which then fire the bullet. The bullet pusher can be motorized to advance bullets faster as the trigger can activate a motor to drive the bullet pusher in a reciprocating manner firing bullets in a rapid fire manner. Other known feeding mechanisms remove physical barriers from a path leading to a launching mechanism and are known to include a biased trigger, that when depressed, removes a barrier and allows a dart or projectile to enter a launch channel for engagement with rotating flywheels or drive wheels to project the dart.

Other known mechanisms utilize a belt surface to elevate or transport projectiles or balls to a launching mechanism or to shoot projectiles such as paper money from a gun. It is known to employ a belt surface with multiple holders that separate the belt surface into compartments so as to carry multiple balls, each ball in its own individual compartment, along the belt surface from a hopper to the launching mechanism. This individual arrangement of balls on the belt surface allows for the feeding of only one ball at a time into the launcher mechanism, even though multiple balls travel together from the hopper to the launcher mechanism.

Also, it is known to dispose a conveyer belt between two conveyor belt drive wheels and dispose a stack of paper currency onto a surface of the belt. Movement of the belt forces sheets of paper currency out a currency exit slot of a gun. Additionally, it is known to secure darts to a belt surface, by storing each dart in its own bracket on the belt. The belt travels through a launcher housing where motorized flywheels lift each dart from its storage compartment and launch each dart from the housing.

Significantly, known toy launchers do not include a feeding/anti-jamming mechanism that penetrates a dart magazine feeding darts into an energy generating mechanism for rapidly firing darts from the toy apparatus without the hassle of mis-fed darts jamming up in the launcher. It is desirable to provide a continuous belt slightly pressing through lips of a dart magazine to reliably release each dart while at the same time employing one or more protrusion elements continually progressing with the belt to advance each released dart into the pathway of an energy generating mechanism.

SUMMARY OF THE INVENTION

The present invention addresses shortcomings of the prior art to provide a toy launch apparatus which extends a feeding/anti-jamming mechanism into a dart magazine releasing and feeding darts into an energy generating mechanism for rapid fire launching of darts from the apparatus without darts jamming up in the launcher. A continuous belt, including one or more protrusion elements at the belt, penetrates lips of the dart magazine slightly pressing on each uppermost dart reliably releasing the dart from the magazine while at the same time activating one of the belt protrusions to advance each released dart into the pathway of the energy generating mechanism.

In one embodiment of the invention, the toy launch apparatus includes a housing assembly, a dart magazine inserted into the housing assembly and having an open end and including retaining lips at the open end, one or more darts loaded into the dart magazine, each dart including a rear advancing surface and a biased advancing mechanism at the dart magazine urging loaded darts toward the open end of the dart magazine. A continuous feeding mechanism is coupled to the housing adjacent the inserted magazine and penetrating the dart magazine at the open end, an energy generating mechanism is in communication with the continuous feeding mechanism, and a motor is driving rotation of the energy generating mechanism.

First and second gears are positioned in parallel relationship to one another and each is including a notched circumferential surface, a second motor at the housing is driving rotation of at least one of the first and second gears.

A continuous belt is stretching between first and second gears and having a first surface including teeth for engaging the notched circumferential surfaces for driving rotation of the belt with rotation of the first and second gears, and a second surface of the belt riding along an uppermost dart disposed in the magazine at the open end urging the dart from contact with the retaining lips of the magazine and into a releasing position. A biasing plate is disposed between first and second gears adjacent the belt and biasing the belt to penetrate the magazine at the open end, and one or more protrusion elements are at the second surface of the belt penetrating the magazine at the open end and engaging the rear advancing surface of the uppermost dart disposed in the releasing position into the energy generating mechanism rapidly firing the dart without it jamming in the toy launch apparatus.

BRIEF DESCRIPTION OF THE DRAWINGS

For the purpose of facilitating an understanding of the inventions, the accompanying drawings and description illustrate preferred embodiments thereof, from which the inventions, structure, construction and operation, and many related advantages may be readily understood and appreciated.

FIG. 4A is illustrating retaining lips at an open end of a dart magazine clip, while

DETAILED DESCRIPTION OF THE EMBODIMENTS

The following description is provided to enable those skilled in the art to make and use the described embodiments set forth in the best modes contemplated for carrying out the invention. Various modifications, however, will remain readily apparent to those skilled in the art. Any and all such modifications, equivalents, and alternatives are intended to fall within the spirit and scope of the present invention.

Figure 1A:
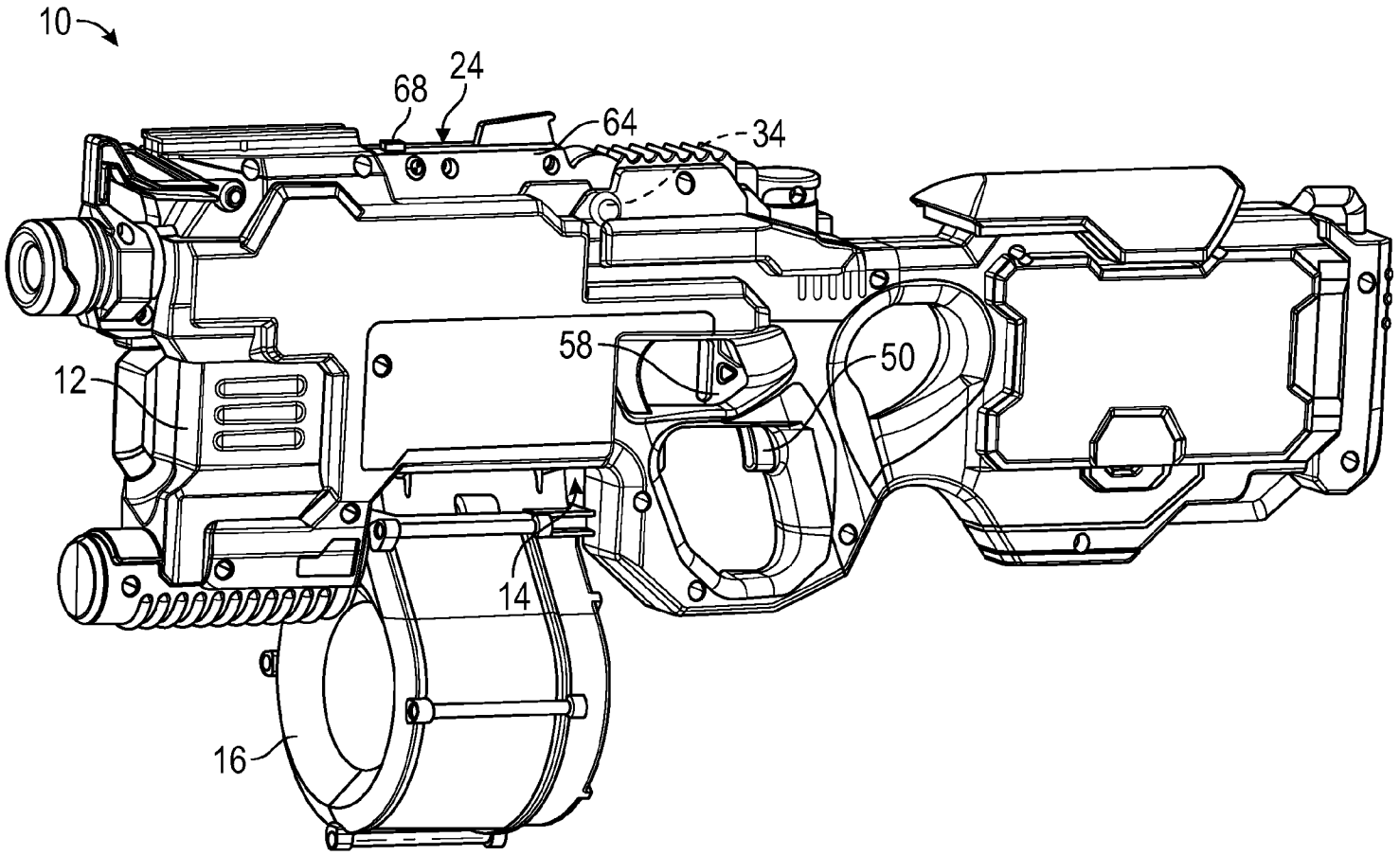
FIG. 1A is a perspective view of a toy launch apparatus of the present invention, with FIG. 1B viewing the toy launch apparatus with parts broken away to illustrate a feeding/anti-jamming mechanism, and FIG. 1C viewing the feeding/anti-jamming mechanism from a slightly different angle than FIG. 1B illustrating a continuous belt penetrating a dart magazine.

A toy launch apparatus 10, as seen in FIG. 1, is generally seen to simulate the shape of a gun and includes a feeding/anti-jamming mechanism that simply yet uniquely releases darts from a magazine then advances the darts into an energy generating mechanism for rapidly firing darts from the launcher without the hassle of darts jamming up in the launcher. The launch apparatus 10 includes a housing assembly 12 generally shaped like a gun or machine gun and includes a slot 14 into which a dart magazine 16 is inserted, as seen in FIG. 1A.

Figure 1B:
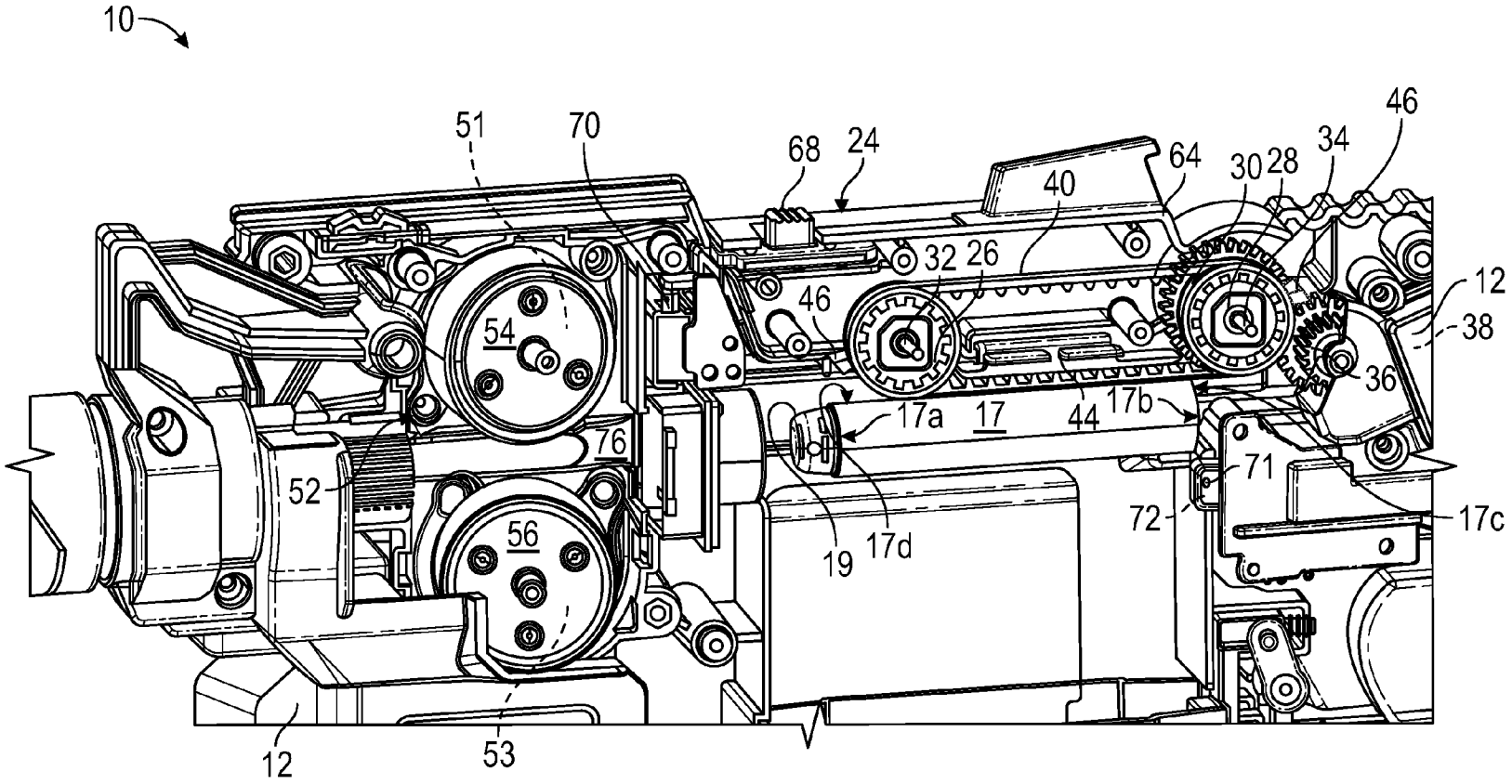
Figure 1C:
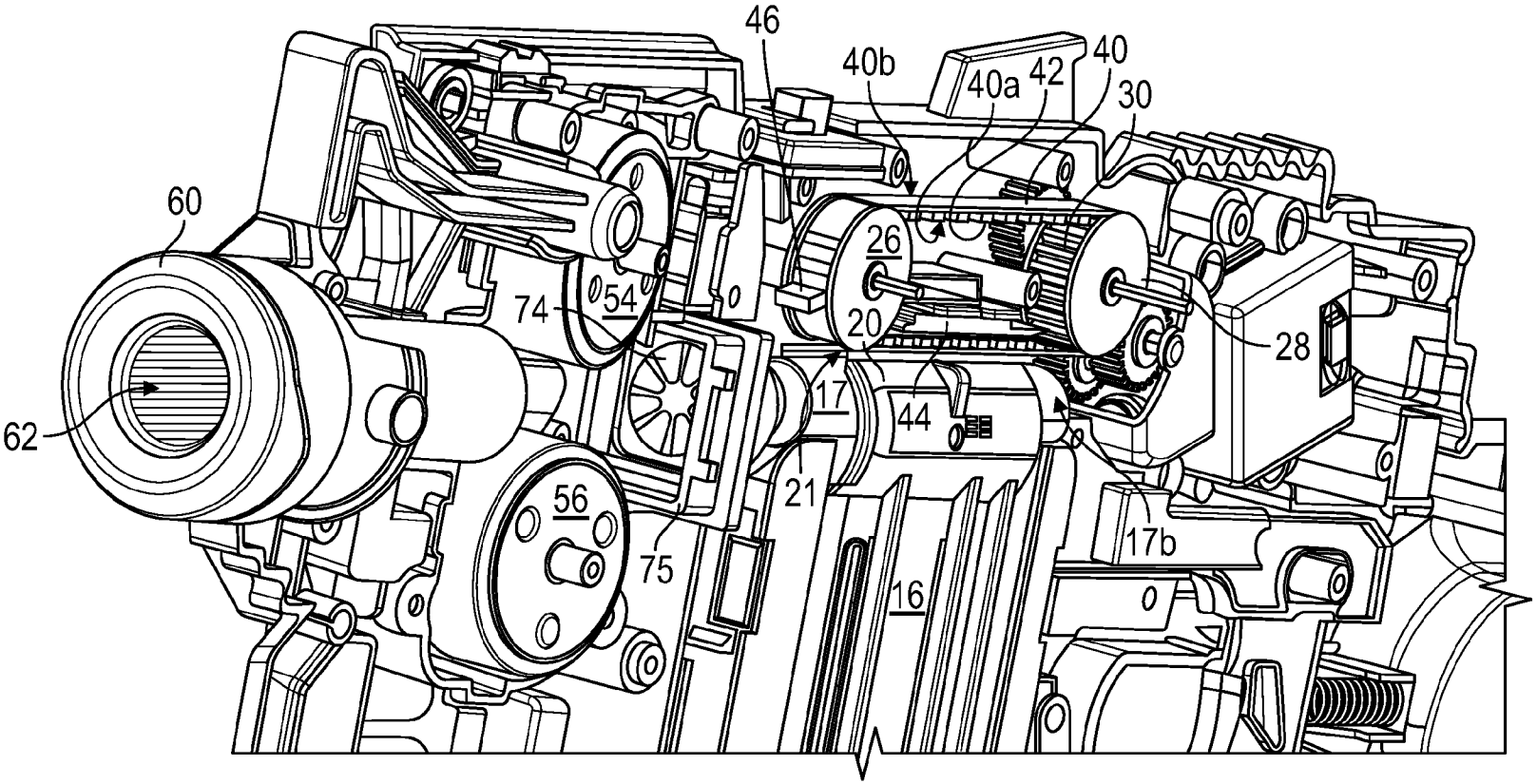
Figure 2:
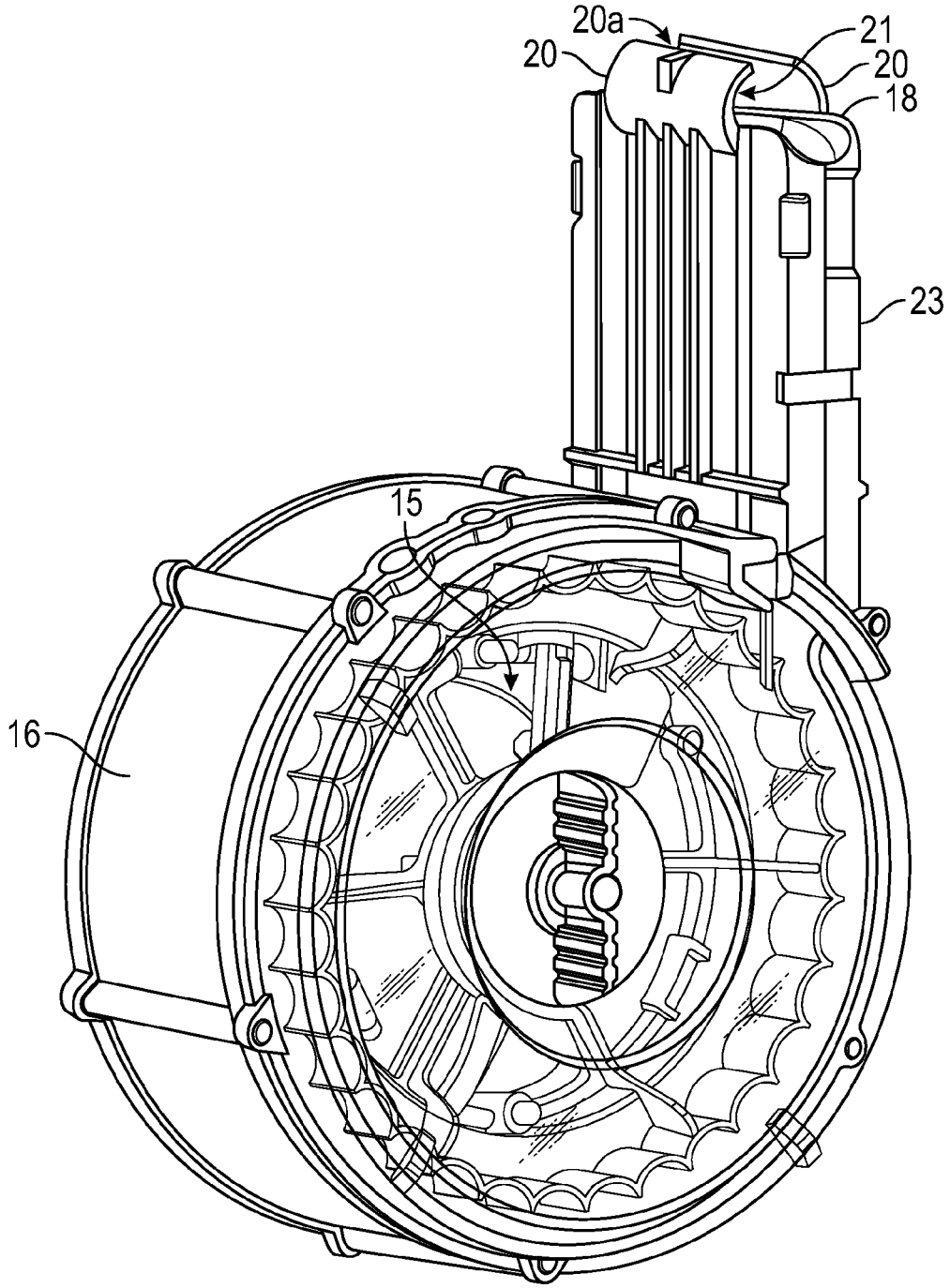
FIG. 2 is illustrating a machine gun magazine for use with the toy launch apparatus.
Figure 3:
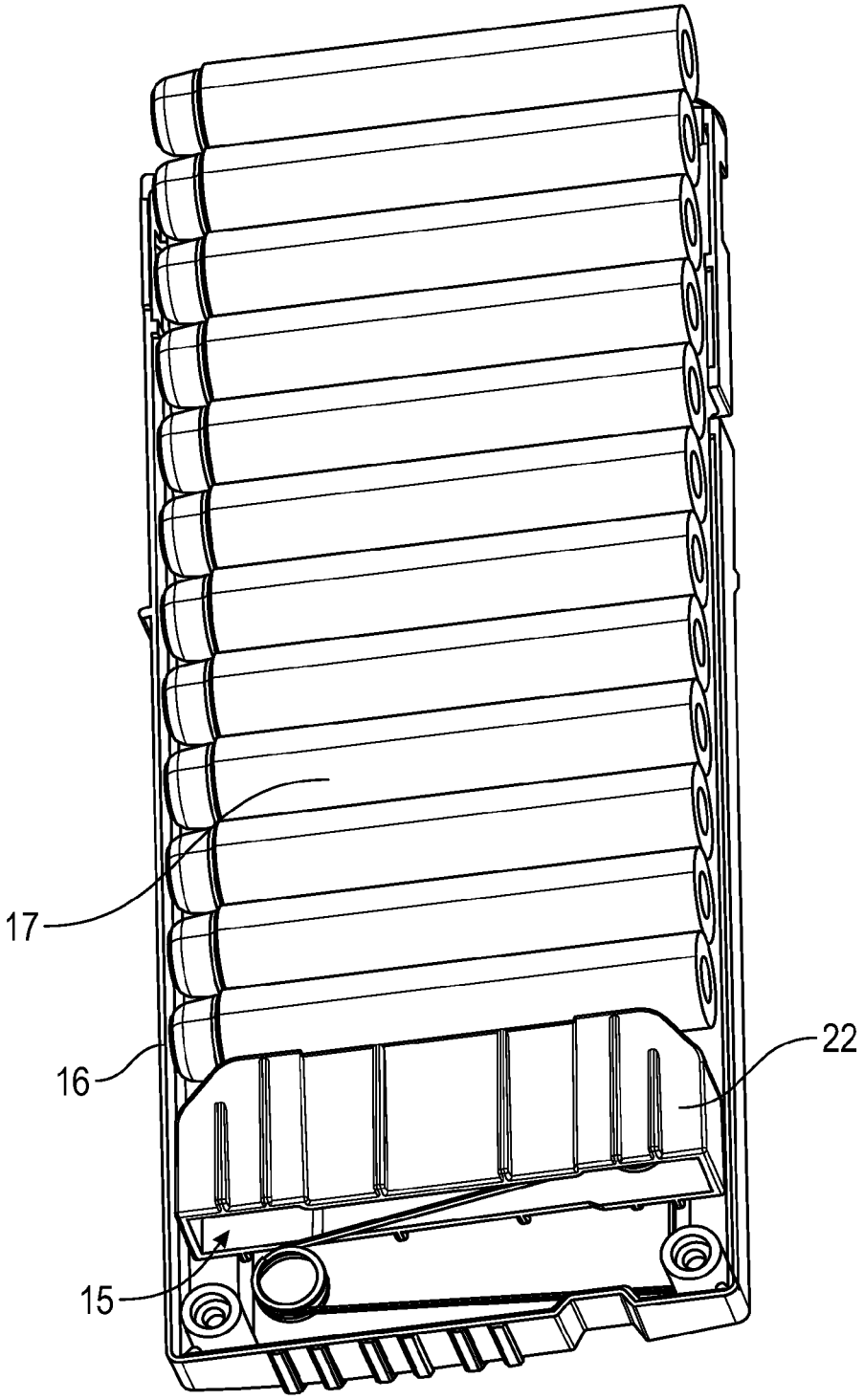
FIG. 3 is illustrating a dart advancing mechanism at a magazine clip for advancing darts into the toy launch apparatus.

The dart magazine 16, as shown in FIGS. 1-2, includes a machine gun type magazine holding 25 or so darts 17, but can also include a straight rectangular magazine holding 6-18 darts 17, etc., as seen in FIG. 3. Additionally, other variations of known dart magazines designed to snap into the slot 14 of the housing assembly 12 and advance darts into the toy launch apparatus 10 are contemplated.

The machine gun type dart magazine 16 holds 25 or more darts in a circular drum and advances retained darts to an open end 18, as seen in FIG. 2. A straight rectangular portion 23, extends from the circular drum and includes the open end 18 for fitting the machine gun magazine into the slot 14 of the toy launch apparatus 10. Similarly, the dart magazine 16 which holds a various number of darts from 6-18, as seen in FIG. 3, is entirely straight and generally rectangular in shape 16 and also advances retained darts 17 toward the open end 18. The rectangular magazine 16, as seen in FIG. 3, is interchangeable with the machine gun magazine and also snaps into slot 14 of the toy launch apparatus 10 at the open end 18 of the magazine. A dart advancing mechanism 15 within the magazine creates a force to bias the retained darts 17 toward the open end 18, in both the magazine gun magazine and the straight rectangular shaped magazine.

Figure 4A:
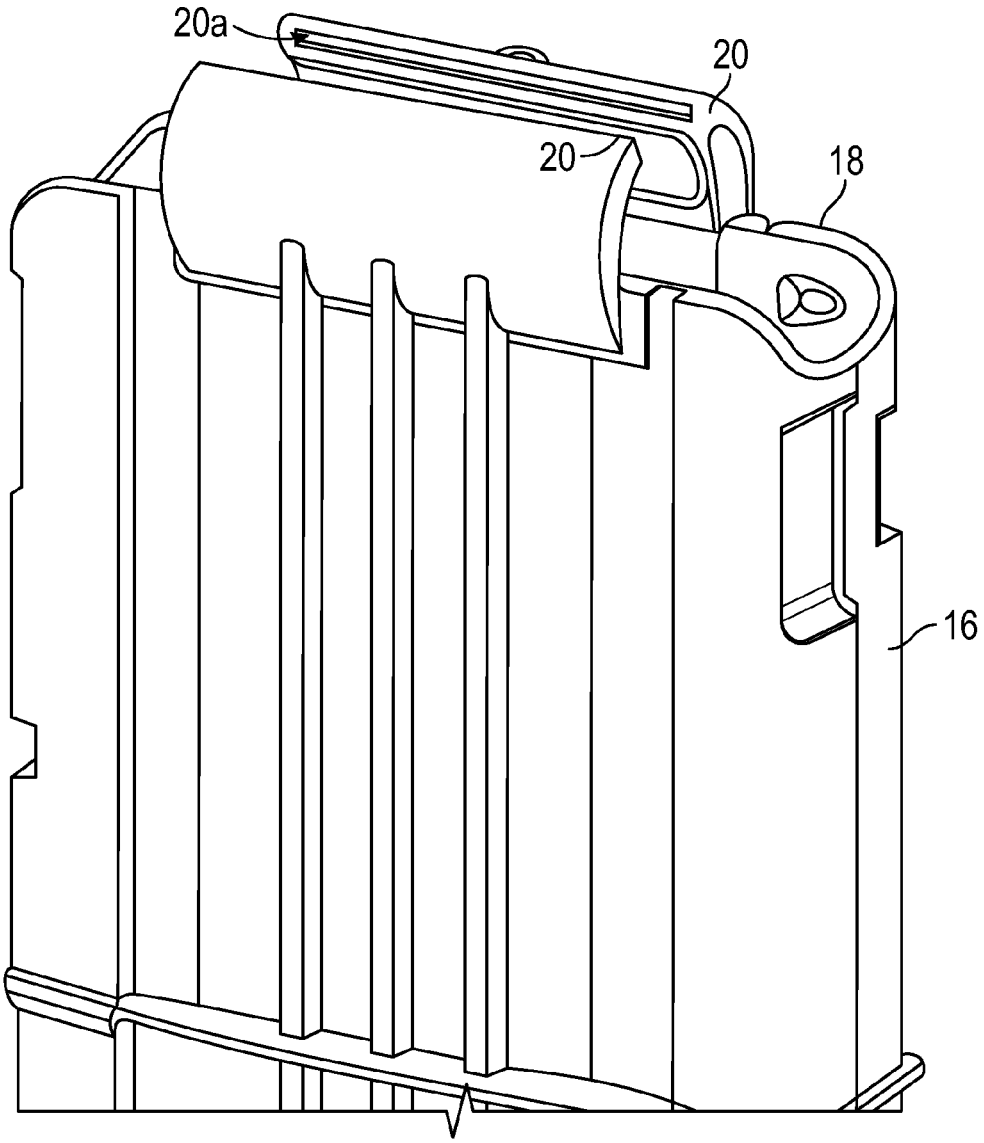
Figure 4B:
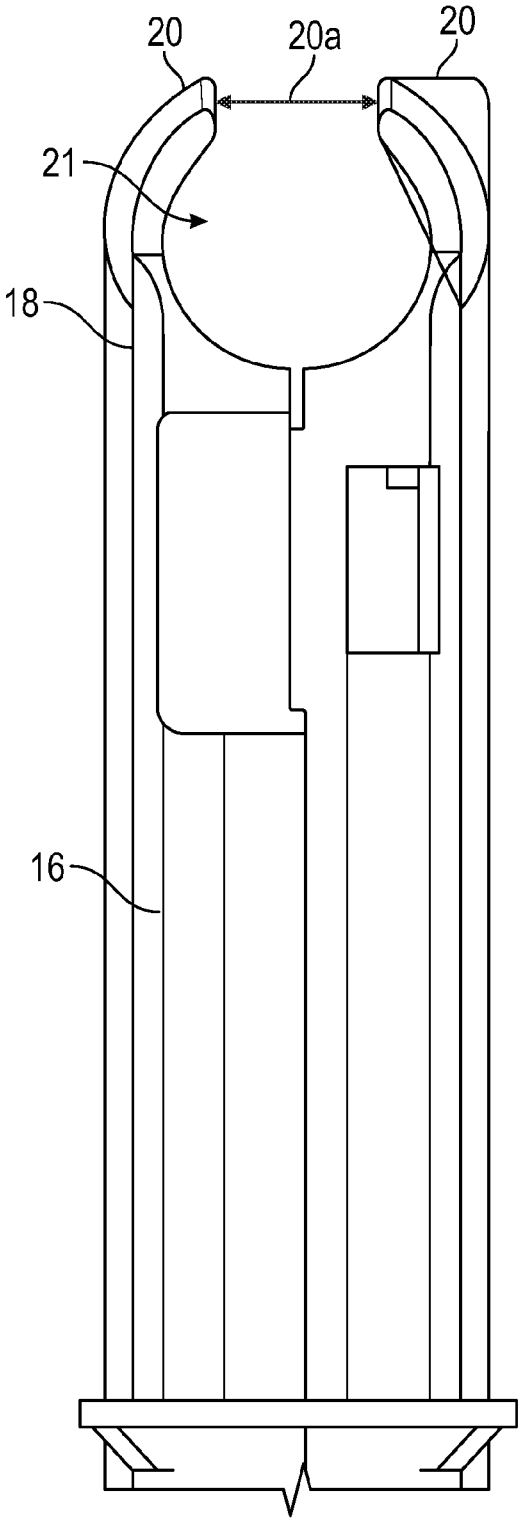
FIG. 4B is illustrating a side view of the retaining lips as they define an open chamber at the open end of the dart magazine clip.

Additionally, the open end 18 of the machine gun magazine, as seen in FIG. 2, is essentially identical to the open end 18 of the entirely straight and rectangular magazine, as seen in FIG. 3, and both the machine gun magazine and the rectangular magazine, as seen in FIGS. 2 and 4, respectively, each include a pair of retaining lips 20 at the open end 18. Each retaining lip 20 extends from an opposite side of the open end 18 of the magazine, with the retaining lips slightly curving toward each other, as seen in FIGS. 4A-4B. The generally C shaped retaining lips together define a retaining space or open compartment 21 for retaining an uppermost dart 17 in the magazine.

The lips 20 do not touch each other as they extend and curve beyond the open end 18 leaving a gap 20*a* between distal ends of the two retaining lips 20. The uppermost dart 17 in the magazine slightly bulges through the gap 20*a* until the magazine is inserted into the housing assembly 12, where the feeding/anti-jamming mechanism 24 urges the dart 17 from the retaining lips, as discussed in further detail below. The dart advancing mechanism 15 creates the force that bulges the uppermost dart 17 into the gap between the retaining lips 20. The dart advancing mechanism 15 advances the retained darts through the magazine and the retaining lips 20 prevent the dart advancing mechanism 15 from pushing the uppermost dart out of the open end of the magazine.

The dart advancing mechanism 15 can include a spring biased platform 22, as seen in FIG. 3, secured to an end of the magazine 16 opposite the open end 18. The secured spring urges the platform toward the open end 18 and advances darts 17 loaded into the magazine clip toward the open end, as seen in FIG. 3. The retaining lips 20, as seen in FIG. 4, prevent the spring biased platform 22 from advancing the loaded/retained darts from the magazine until the magazine is inserted into the toy launch apparatus 10 and readied for launching, as discussed in more detail below.

The darts 17 are generally manufactured from a foam material and include a first end 17*a* and a second end 17*b*, as best seen in FIG. 1B. A dart tip 19 is coupled at the first end 17*a* of the dart 17 and a rear advancing surface 17*c* is included at the second end 17*b*. The dart tip 19 is generally manufactured from a flexible plastic material and the dart tip 19 is generally heavier in weight than the dart 17 (body) which is manufactured from foam.

A continuous feeding/anti-jamming mechanism 24, as seen in FIGS. 1B-1C, is coupled to the housing assembly 12 adjacent the inserted magazine 16 and extends into the dart magazine at the open end 18 for releasing darts from the magazine and feeding darts into an energy generating mechanism without darts jamming up in the launcher. First and second tooth pulleys (or alternatively first and second gears) 26 and 28, respectively, are positioned in parallel relationship to one another and each pulley includes a notched circumferential surface 30. Each of the first and second pulleys are coupled to an axel 32 and 34, respectively, with each, or both pulleys driven for rotation about their axel.

In the present described embodiment, the second pulley 28 is coupled to a gear train 36 linked to second axel 34 and driven for rotation by a motor 38. One or more gears of the gear train 36 ride on second axel 34 adjacent second pulley 28, driving rotation of second pulley 28 in a continuous fashion as long as motor 38 is activated. Additionally, in the present described embodiment, first pulley 26 is an idler pulley that rotates though a linkage with second pulley 28 as motor 38 drives rotation of second pulley 28. A continuous belt 40 becomes the linkage between idler pulley 26 and second pulley 28.

Continuous belt 40 extends between first and second pulleys, 26 and 28, respectively, linking idler pulley 26 with second pulley 28, as seen in FIGS. 1B-1C. The belt 40 extends and/or stretches generally taut between pulleys 26 and 28 so that there is not much slack in the belt as it is rotated around the pulleys, insuring that belt 40 will not detach from the pulleys regardless of the right side up or upside down positioning of the toy launch apparatus 10.

The belt 40 includes first and second belt surfaces, 40*a* and 40*b*, respectively, as seen in FIGS. 1B and 1C. Numerous teeth 42 protrude from first surface 40*a* and engage the notched circumferential surfaces of pulleys 26 and 28. The teeth 42 of belt 40 securely insert into the notched surfaces of pulleys 26 and 28 and efficiently drive belt 40 to rotate between first and second pulleys in a rapid fashion. The secure fit between the teeth of the belt and the notched circumferential surfaces of each pulley also helps to insure that the belt will not detach form the pulleys regardless of the speed of the belt rotation or the positioning of the toy launcher apparatus.

Figure 5:
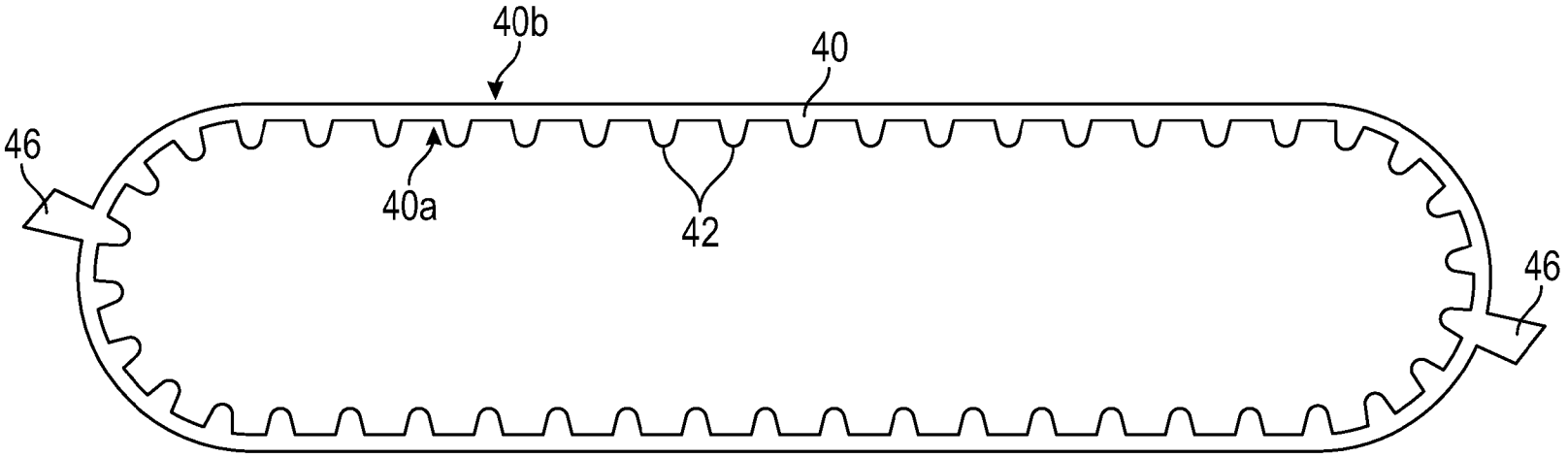
FIG. 5 is illustrating a continuous belt including teeth at a first surface and two protrusion elements at a second surface.

The belt 40 is generally circular, as seen in FIG. 5, and manufactured from a nitrile butadiene rubber, providing the necessary strength, firmness and flexibility needed to maintain the belts shape and integrity during long term use without breaking down or shredding into pieces. Additionally, the flexibility of the rubber belt 40 allows the belt to maintain its desired shape and positioning as it is rotated around the pulleys and allows the belt to be biased into the inserted dart magazine at the open end. The flexible rubber material of the belt 40 allows the belt to glide over the uppermost dart 17 at the open end of the magazine slightly urging the dart away from the lips of the magazine and releasing the dart from contact with the lips of the magazine. The continuous/endless penetrating belt 40 positions each uppermost dart into a releasing position and ready for advancement into the energy projecting mechanism without deforming the uppermost dart in any way or prematurely advancing the dart into the energy projecting mechanism.

In the present described embodiment, the teeth 42 are also manufactured from nitrile butadiene rubber and are integral with the belt. It is also contemplated that the teeth can be made from an alternative rubber or plastic material and that the teeth could be coupled to the belt. The nitrile butadiene rubber material of the teeth 42 provides the necessary strength, firmness and flexibility required to engage the notched circumferential surfaces of the first and second pulleys while maintaining their shape and integrity during long term use without breaking down or breaking off from the belt. Also, the rubber material of the teeth, of the present described embodiment, provide additional friction between the teeth and the notched surfaces of the first and second pulleys such that the teeth grip the notched surfaces without slipping or dislodging the belt from either gear.

As mentioned above, the rubber belt 40 is sufficiently flexible to be urged or biased into the inserted dart magazine at the open end as the belt is rotated around first and second pulleys, 26 and 28, respectively, as seen in FIGS. 1B and 1C. A biasing plate and/or support 44 is disposed at the continuous feeding/anti-jamming mechanism 24 between first and second pulleys adjacent the belt. The biasing plate 44 urges or biases the belt to penetrate or extend into the inserted dart magazine at the open end. In the present described embodiment, the biasing plate 44 is manufactured from a durable plastic material and is integral with the continuous feeding/anti-jamming mechanism 24.

One or more protrusion elements 46 are disposed at the belt 40 at the second surface 40*b*, as seen in FIGS. 1C and 5. The protrusion elements 46 ride along the second (or outside) surface 40*b* of the belt as the belt is rotated around the first and second pulleys. The protrusion elements 46 extends from the second surface of the belt and penetrate or extend into the dart magazine 16 at the open end when the magazine is inserted into the launch apparatus 10. The protrusion elements 46 engage the rear advancing surface 17*c* of the uppermost dart disposed in the inserted magazine at the open end. Protrusion elements 46 can occur at any point along the second surface 40*b* of the belt in any desired quantity.

In the present described embodiment, two protrusion elements 46 are integral with the belt 40 at the second surface 40*b*, and are spaced 180 degrees apart from each other, as seen in FIG. 5. The protrusion elements 46 are manufactured from the same nitrile butadiene rubber material as the belt and extend a distance from the belt that is only slightly longer than the distance the teeth 44 extend from the belt 40 in the opposite direction at the opposite surface 40*a*. The short profile and flexible constitution of the protrusion elements 46 allows these protrusion elements 46 to glide along the uppermost surface 17*d* of the uppermost dart 17, without damaging or deforming the dart, or prematurely advancing the dart from the magazine until one of the protrusion elements 46 comes into contact with the rear advancing surface 17*c* of the dart 17. The protrusion elements 46 will come into contact with the rear advancing surface 17*c* of the uppermost when dart and advance the dart into the energy generating mechanism only after the belt surface 40*b* has urged the uppermost dart into the releasing position.

It is important that the protrusion elements 46 do not prematurely advance the darts from the magazine into the energy generating mechanism, but rather advance the darts only when the uppermost dart is correctly positioned for optimal launching from the launch apparatus thus preventing the darts from being mis-fed into the energy generating mechanism and jamming up in the launcher. The feeding/anti-jamming mechanism 24 provides a positioning and timing correction to the release and advancement of darts from the magazine into the energy generating mechanism to significantly reduce the incidence of darts jamming up in the toy launch apparatus. The feeding/anti-jamming mechanism 24 is designed to reliably release the uppermost dart from the retaining lips of the inserted magazine and simultaneously time the advancement of the released dart into the energy generating mechanism. In the present described embodiment, the continuously rotating belt 40 urges the uppermost dart 17 into a releasing position while at the same time rotating protrusion elements which simultaneously time the advancement of the correctly positioned released darts.

Darts 17 advance through the magazine as the advancing force from the dart advancing mechanism 15 is exerted against the darts loaded in the magazine. Darts pop up one by one into the retaining space or open compartment 21 between the retaining lips 20 before being advanced into the path of the energy generating mechanism. As the darts pop up into the open compartment 21, the heavier dart tip 19 is slightly tilted toward the magazine and lags behind the foam dart (body) when advanced into the compartment 21. If the dart is advanced or travels from the magazine while still in this slightly tilted position, the dart will not correctly feed into the energy generating mechanism and will jam up inside the launcher. This is especially likely to occur when darts are rapidly advanced into the energy generating mechanism from the dart magazine for rapid fire launching of darts from the toy.

In the present described embodiment, the feeding/anti-jamming mechanism provides reliable positioning and timing of darts advanced from the magazine to the feeding/anti-jamming mechanism, eliminating darts misfiring from the toy launch apparatus. The feeding/anti-jamming mechanism is automatically designed to wait until darts are correctly positioned before feeding the darts into the energy generating mechanism, while at the same time continuously running the mechanism. The rotating belt 40 is uniquely designed to both run continuously to urge the uppermost dart to a releasing position, and also essentially wait to feed darts into the energy generating mechanism until the uppermost dart in the magazine is in a correct (essentially level) position, as discussed above.

The belt surface 40*b* is too slippery to grab the dart 17 and prematurely advance it into the energy generating mechanism, but rather, the belt glides across a dart residing in the compartment 21 of the magazine and urges the dart away from the lips 20 of the magazine while leveling the dart tip 19 with the foam dart body 17, correctly positioning the dart for advancement into the energy generating mechanism. Additionally, the low profile and flexible constitution of the protrusion elements 46 allow the protrusion elements to travel across the dart surface 17*d*, as seen in FIG. 1B, until the belt 40 has correctly positioned the dart and made the rear advancing surface 17*c* accessible to the protrusion elements 42. Once the dart is correctly positioned, and no longer slightly tilted, a protrusion element 46 will automatically engage the rear advancing surface 17*c* of the dart to grab and advance the dart into the energy generating mechanism. The simultaneous positioning of each uppermost dart by the belt 40, with the correct contact timing of the protrusion element with the rear contacting surface 17*c* of the positioned dart, advances each uppermost dart from the magazine in a rapid fire fashion without jamming darts in the toy launcher apparatus 10.

In use, a first trigger 50, as seen in FIG. 1A, is depressed by a user and activates both motors 51 and 53 which drive the energy generating mechanism 52. In the present described embodiment, the energy generating mechanism 52 includes two opposed rotatable wheels, 54 and 56 which engage and advanced darts there between. Motors 51 and 53 drive rotation of wheels 54 and 56, respectively, creating a launching force frictionally applied to the dart as the dart engages a wheel surface on each of the opposed rotatable wheels. The rotating wheels impart sufficient energy to the dart to launch the dart from the toy launch apparatus. As seen in FIG. 1B, motor 51 is contained within drive wheel 54 and motor 53 is contained within drive wheel 56, such that activated motor 51 drives rotation of wheel 54 and activated motor 53 drives rotation of wheel 56.

Additionally, the user depresses a second trigger 58, as seen in FIG. 1A, which activates a second motor 38 which rotates the feeding/anti-jamming mechanism 24. The second motor 38 is disposed within the housing 12 and positioned behind a part of the housing, as seen in FIG. 1B. Pulley 28 is rotated in a clockwise direction rotating belt 40 about pulleys 26 and 28. The biasing plate 44 urges belt 40 into the inserted magazine and with the second surface 40*b* of the belt gliding along the uppermost dart residing in compartment 21 and urging the uppermost dart away from contact with the retaining lips 20 and into a releasing position. Continuous rotation of the belt rotates protrusion elements 46 into contact with the now accessible rear advancing surface 17*c* of the leveled dart in the releasing position and advances the dart into the energy generating mechanism, which fires the dart through an exit 62 in a barrel 60 of the toy launch apparatus.

Figure 6A:
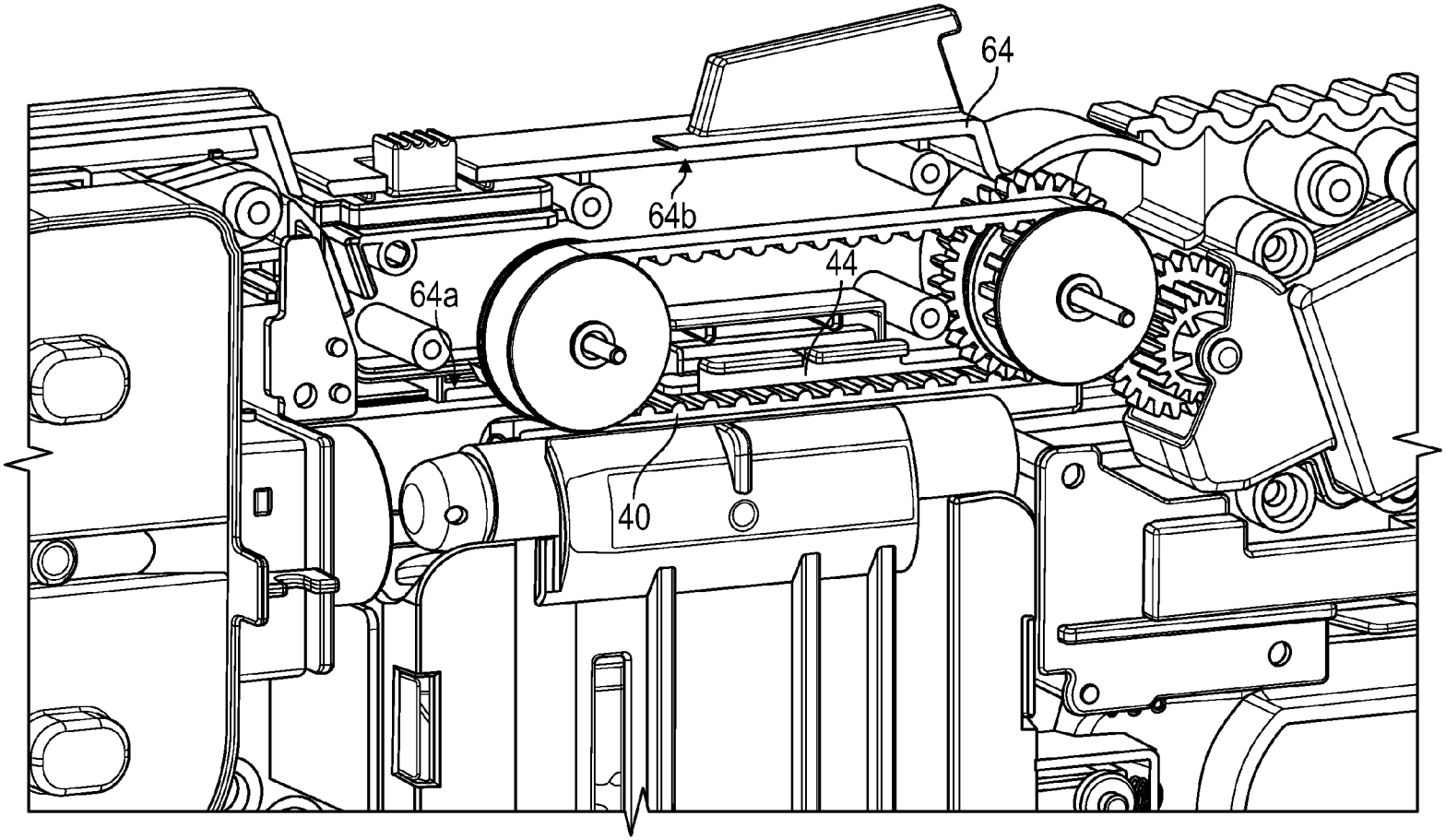
FIG. 6A illustrates the feeding/anti-jamming mechanism contained in a clam shell housing and pivotable within the toy launch apparatus.
Figure 6B:
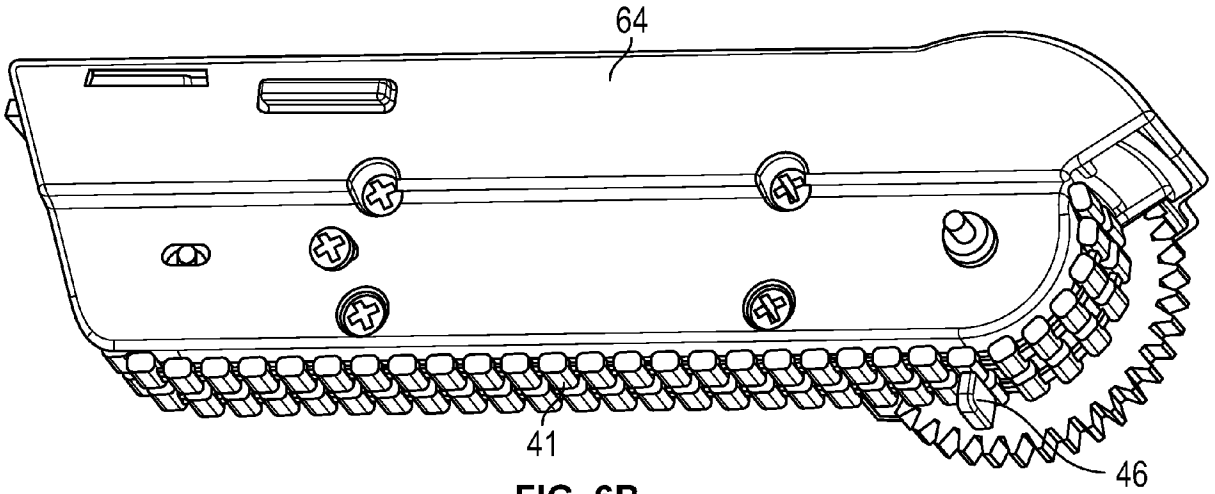
FIG. 6B illustrates an alternate feeding/anti-jamming mechanism.
Figure 7:
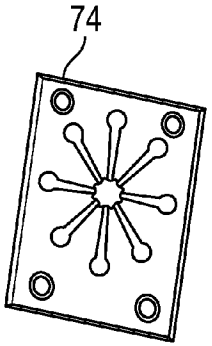
FIG. 7 is illustrating a flexible barrier providing a safety measure to resist the advancement of projectiles not designed or intended to be advanced into an energy generating mechanism and fired from the toy launch apparatus.

In the present described embodiment, the feeding/anti-jamming mechanism 24 is contained within a clam shell housing 64, as seen in FIG. 6A, open at a first side 64*a* to the inserted dart magazine 16. The clam shell housing 64 is closed at the second side 64*b* and partially wraps around both pulleys 26 and 28 with the biasing plate 44 and belt 40 protruding from the open first side 64*a* of the housing 64. The clam shell housing 64 is inserted into the toy launch apparatus adjacent the gear train 36 and is pivotably coupled to the housing 12 at second axel 34. The second axel 34 is seen in FIG. 1B, and the location of the second axel 34, as seen in FIG. 1A, illustrates where clam shell housing 64 can pivot a jam door to clear any objects from inside the toy launch apparatus. FIG. 6B represents an alternative embodiment where chain 41 may be employed without plate 44, and further alternative may avoid the biasing plate 44 with alternate support, supporting mechanism, pulleys, gears or the like to maintain continued contact of pushing belt or chain with the protrusion 46 with the rear advancing surface 17*c* of the dart 17 is pushed forward.

A sliding lock 68 is disposed at the second side 64*b* of the clam shell housing 64 and is in a locked position to maintain the housing 64 and contained feeding/anti-jamming mechanism in proper engagement with the dart magazine and other presently described mechanisms of the toy launch apparatus. A limit switch 70 is closed/inactivated when the sliding lock 68 is in a locked position maintaining a proper connection between the motors 38, 51 & 53 and a power supply to keep the motors running, as seen in FIG. 1B. Alternatively, when the sliding lock is in an unlocked position in order to pivot the clam shell housing 64 away from the toy housing 12, the limit switch 70 is open/activated blocking the power supply to the motors and preventing the motors from running when the jam door is open.

A second limit switch 72, not seen in FIG. 1B but positioned behind lever 71, is disposed within the slot 14 for capturing the inserted dart magazine, The second limit switch 72 is designed to look and operate in a similar manner as to limit switch 70. Limit switch 72 is closed/inactivated when a dart magazine is inserted into slot 14 allowing power to motor 38 and switch 72 is open/activated to cut off power to motor 38 when dart magazine 16 is removed from slot 14.

A soft barrier 74, as seen in FIG. 1C, is disposed at the housing 12 between the energy generating mechanism 52 and the feeding/anti-jamming mechanism 24 in the pathway the dart 17 travels from the dart magazine to the energy generating mechanism, as a safety mechanism, as seen in FIG. 1C. In the present described embodiment, the soft barrier 74 is manufactured from a silicone material with a perforated opening and is supported by a frame 75, however, it is also contemplated that the soft barrier can be manufactured from other materials such as plastic which is flexible enough for a dart to penetrate a perforated opening, but rigid enough to prevent unintended objects from entering the energy generating mechanism. The soft barrier 74 provides just enough resistance to prevent a projectiles less than two inches in length from getting into the energy generating mechanism. Object less that two inches in length could be a choking hazard and are undesirable projectiles to be fired from a toy launch apparatus. Also, the soft barrier 74 may prevent unintended and improvised projectiles from getting into the energy generating mechanism and being fired from the toy launch apparatus.

Additionally, in the present described embodiment, it is desirable keep the distance between the axel 32 of the first gear 26 and the entrance 76 into the energy generating mechanism to 51 mm or more, as a safety precaution to keep small projectiles (typically less than two inches) out of the energy generating mechanism and fired from the toy launch apparatus. Projectiles less than 51 mm will not be long enough to stretch the gap between the feeding/anti-jamming mechanism and the energy generating mechanism, and will fall to the interior of the housing 12 without ever being fired from the toy launch apparatus.

While a particular embodiment of the present invention has been shown and described, it will be obvious to those skilled in the art that changes and modifications may be made without departing form the invention in its broader aspects. Therefore, the aim in the appended claims is to cover all such changes and modifications as fall within the true spirit and scope to the invention. The matter set forth in the foregoing description and accompanying drawings is offered by way of illustration only and not as a limitation. The actual scope to the invention is intended to be defined on the following claims when viewed in their proper perspective based on the prior art.

What is claimed is:

1. A dart launch apparatus, comprising:

a housing assembly;

a dart magazine inserted into the housing assembly and having an open end and including dart retaining lips at the open end;

one or more darts loaded into the dart magazine, each dart including a rear advancing surface;

a biased dart advancing mechanism at the dart magazine urging loaded darts toward the open end of the dart magazine;

a continuous feeding/anti-jamming mechanism coupled to the housing adjacent the inserted magazine and penetrating the dart magazine at the open end;

an energy generating mechanism in communication with the continuous feeding mechanism; and a motor driving rotation of the energy generating mechanism.

2. The dart launch apparatus recited in claim 1 comprising first and second tooth pulleys positioned in parallel relationship to one another and each including a notched circumferential surface.

3. The dart launch apparatus recited in claim 2 comprising a second motor at the housing for driving rotation of at least one of the first and second pulleys.

4. The dart launch apparatus recited in claim 3 comprising a continuous belt extending between first and second pulleys and having a first surface including teeth for engaging the notched circumferential surfaces for driving rotation of the belt with rotation of the pulleys.

5. The dart launch apparatus recited in claim 4 comprising a second surface of the belt riding along an uppermost dart disposed in the magazine at the open end urging the dart from contact with the retaining lips of the magazine and into a releasing position.

6. The dart launch apparatus recited in claim 5 comprising a support disposed between first and second pulleys adjacent the belt biasing the belt to penetrate the magazine at the open end.

7. The dart launch apparatus recited in claim 6 comprising one or more protrusion elements at the second surface of the belt penetrating the magazine at the open end engaging the rear advancing surface of the uppermost dart disposed in the releasing position into the energy generating mechanism rapidly firing the dart.

8. The dart launch apparatus recited in claim 4 comprising a second surface of the belt riding along an uppermost dart disposed in the magazine at the open end urging the dart from contact with the retaining lips of the magazine and into a releasing position.

9. The dart launch apparatus recited in claim 8 comprising one or more protrusion elements at the second surface of the belt penetrating the magazine at the open end engaging the rear advancing surface of the uppermost dart disposed in the releasing position into the energy generating mechanism rapidly firing the dart without it jamming in the dart launch apparatus.

10. A dart launch apparatus, comprising:

a housing assembly;

a dart magazine inserted into the housing assembly and having an open end and including dart retaining lips at the open end for retaining loaded darts that include a rear advancing surface;

a biased dart advancing mechanism at the dart magazine urging loaded darts toward the open end of the dart magazine;

a continuous feeding mechanism coupled to the housing adjacent the inserted magazine and penetrating the dart magazine at the open end;

an energy generating mechanism in communication with the continuous feeding mechanism;

first and second tooth pulleys positioned in parallel relationship to one another and each including a notched circumferential surface; and a continuous belt extending between first and second pulleys and having a first surface including teeth for engaging the notched circumferential surfaces for driving rotation of the belt with rotation of the pulleys, and a second surface of the belt riding along an uppermost dart disposed in the magazine at the open end urging the dart from contact with the retaining lips of the magazine and into a releasing position.

11. The dart launch apparatus recited in claim 10 comprising a motor driving rotation of the energy generating mechanism, with the energy generating mechanism in communication with the continuous feeding mechanism.

12. The dart launch apparatus recited in claim 11 comprising a second motor at the housing for driving rotation of at least one of the first and second pulleys.

13. The dart launch apparatus recited in claim 12 comprising a support disposed between first and second pulleys adjacent the belt biasing the belt to penetrate the magazine at the open end.

14. The dart launch apparatus recited in claim 13 comprising one or more protrusion elements at the second surface of the belt penetrating the magazine at the open end engaging the rear advancing surface of the uppermost dart disposed in the releasing position into the energy generating mechanism rapidly firing the dart.

15. The dart launch apparatus recited in claim 13 wherein the continuous feeding mechanism comprises an anti jamming mechanism at the housing and adjacent the inserted magazine.

16. The dart launch apparatus recited in claim 15 comprising one or more protrusion elements at the second surface of the belt penetrating the magazine at the open end engaging the rear advancing surface of the uppermost dart disposed in the releasing position into the energy generating mechanism rapidly firing the dart without it jamming in the dart launch apparatus.

17. A dart launch method, comprising:

inserting a dart magazine inserted into a housing assembly and having an open end and including dart retaining lips at the open end;

loading one or more darts into the dart magazine, each dart including a rear advancing surface;

biasing a dart advancing mechanism at the dart magazine urging loaded darts toward the open end of the dart magazine;

coupling a continuous feeding mechanism to the housing adjacent the inserted magazine and penetrating the dart magazine at the open end;

providing a motor for driving rotation of an energy generating mechanism in communication with the continuous feeding mechanism;

positioning first and second tooth pulleys in parallel relationship to one another with each including a notched circumferential surface;

providing a second motor at the housing for driving rotation of at least one of the first and second pulleys; and extending a continuous belt between first and second pulleys and having a first surface including teeth for engaging the notched circumferential surfaces for driving rotation of the belt with rotation of the pulleys, and a second surface of the belt riding along an uppermost dart disposed in the magazine at the open end urging the dart from contact with the retaining lips of the magazine and into a releasing position.

18. The dart launch method recited in claim 17 providing a support disposed between first and second pulleys adjacent the belt biasing the belt to penetrate the magazine at the open end.

19. The dart launch method recited in claim 18 further providing one or more protrusion elements at the second surface of the belt penetrating the magazine at the open end engaging the rear advancing surface of the uppermost dart disposed in the releasing position into the energy generating mechanism rapidly firing the dart without it jamming in the dart launch apparatus.

20. A dart launch apparatus, comprising:

a housing assembly;

a slot at said housing assembly with structure to receive a dart magazine into the housing assembly, the dart magazine having an open end and including dart retaining lips at the open end;

a biased dart advancing mechanism at the dart magazine urging loaded darts toward the open end of the dart magazine;

a continuous feeding/anti-jamming mechanism coupled to the housing adjacent the dart magazine and penetrating the dart magazine at the open end;

an energy generating mechanism in communication with the continuous feeding mechanism; and a motor driving rotation of the energy generating mechanism.

21. The dart launch apparatus recited in claim 20 wherein the structure with said housing assembly at the slot to receive the dart magazine comprises structure to snap the dart magazine into the slot of the housing assembly.

22. The dart launch apparatus recited in claim 20 comprising first and second pulleys positioned in parallel relationship to one another coupled to the housing adjacent the dart magazine and having a continuous belt including a first surface for rotation therewith, and the continuous belt extending between the first and the second pulleys.

23. The dart launch apparatus recited in claim 22 comprising a second surface of the continuous belt having one or more protrusion elements for penetrating the dart magazine at the open end, engaging with an uppermost loaded dart disposed in the dart magazine open end and urging the uppermost dart to a releasing position into the energy generating mechanism for firing the dart.

* * * * *